US009335026B2

(12) United States Patent
Stockman

(10) Patent No.: US 9,335,026 B2
(45) Date of Patent: May 10, 2016

(54) ATTACHABLE LIGHTING DEVICE FOR A BOAT

(71) Applicant: American Radionic Company, Inc., Palm Coast, FL (US)

(72) Inventor: Robert M. Stockman, Palm Coast, FL (US)

(73) Assignee: American Radionic Company, Inc., Palm Coast, FL (US)

( * ) Notice: Subject to any disclaimer, the term of this patent is extended or adjusted under 35 U.S.C. 154(b) by 145 days.

(21) Appl. No.: 14/210,788

(22) Filed: Mar. 14, 2014

(65) Prior Publication Data

US 2014/0268841 A1 Sep. 18, 2014

Related U.S. Application Data

(60) Provisional application No. 61/783,139, filed on Mar. 14, 2013.

(51) Int. Cl.

| | |
|---|---|
| ***B63B 45/04*** | (2006.01) |
| ***F21V 21/096*** | (2006.01) |
| ***F21V 9/08*** | (2006.01) |
| ***F21V 21/08*** | (2006.01) |

(52) U.S. Cl.

CPC ..... *F21V 9/083* (2013.01); *B63B 45/04* (2013.01); *F21V 21/0832* (2013.01); *F21V 21/096* (2013.01)

(58) Field of Classification Search

CPC ..... B63B 45/00; B63B 45/02; B63B 45/04; B63B 45/06; F21V 21/0808; F21V 21/0816; F21V 21/0832; F21V 21/096; F21V 21/0965; F21V 9/08; F21V 9/083

See application file for complete search history.

(56) References Cited

U.S. PATENT DOCUMENTS

| | | | | |
|---|---|---|---|---|
| 3,043,949 | A * | 7/1962 | Smith | B63B 45/00 248/315 |
| 4,423,472 | A * | 12/1983 | Duthu | B63B 45/04 362/158 |
| 5,136,477 | A * | 8/1992 | Lemmey | F21L 4/04 362/109 |
| 5,664,866 | A * | 9/1997 | Reniger | B63B 45/04 362/310 |
| 5,704,704 | A * | 1/1998 | Reichard | B63B 45/04 362/267 |
| 5,901,890 | A * | 5/1999 | Stokes | A01K 97/10 114/343 |
| 6,641,288 | B1 * | 11/2003 | Olsen | B60Q 1/2615 362/477 |
| 7,163,312 | B2 | 1/2007 | Woodyard | |
| 7,249,864 | B2 | 7/2007 | Smith et al. | |
| 7,837,365 | B1 | 11/2010 | Sisko | |
| 7,862,197 | B2 * | 1/2011 | Gebhard | B60Q 1/24 248/206.5 |
| 7,959,335 | B1 * | 6/2011 | Hopkins | B63B 45/02 362/230 |
| 8,167,450 | B2 * | 5/2012 | Hudson | F21L 4/00 362/182 |
| 8,414,166 | B1 * | 4/2013 | Charles | B63B 45/02 362/368 |
| 2006/0291217 | A1 | 12/2006 | Vanderschuit | |
| 2007/0256622 | A1 * | 11/2007 | Charles | B63B 45/02 114/364 |
| 2011/0096559 | A1 * | 4/2011 | Peng | B60Q 1/32 362/477 |

* cited by examiner

*Primary Examiner* — Alan Cariaso
(74) *Attorney, Agent, or Firm* — Fish & Richardson P.C.

(57) ABSTRACT

In some aspects of the disclosure, an attachable lighting device has a lighting assembly which includes a light housing, an attaching base, and one or more optical sources. The light housing is attached to the top of the attaching base and contains the one or more optical sources. The attachable lighting device has a receiving base which is attachable to an attachment surface of a boat. The attaching base is attachable to the receiving base.

19 Claims, 7 Drawing Sheets

ATTACHABLE LIGHTING DEVICE FOR A BOAT

CLAIM OF PRIORITY

This application claims priority under 35 USC §119(e) to U.S. Patent Application Ser. No. 61/783,139, filed on Mar. 14, 2013, the entire contents of which are hereby incorporated by reference.

TECHNICAL FIELD

This disclosure relates to an attachable lighting device for a boat.

BACKGROUND

Lights mounted on a boat may be used for a number of purposes. For example, the lights may allow the boat to be visible in the dark. The lights may serve as a beacon and convey a signal to nearby boats.

SUMMARY

In general, in some aspects of the disclosure, an attachable lighting device has a lighting assembly which includes a light housing, an attaching base, and one or more optical sources. The light housing is attached to the top of the attaching base and contains the one or more optical sources. The attachable lighting device has a receiving base which is attachable to an attachment surface of a boat. The attaching base is attachable to the receiving base.

In some implementations, the attaching base may be attachable to the receiving base by magnetic force. The receiving base may be substantially flat. The thickest portion of the receiving base may be less than 0.05 inches. The receiving base may be embedded in the attachment surface. The receiving base may have one or more clearance holes and may be held by one or more screws to the attachment surface. The one or more optical sources may emit light with colors that are substantially red or green or white or the combination thereof. The light housing may include one or more windows which are transparent or translucent or the combination thereof. The one or more windows may include one or more color filters or coatings. The receiving base may be made from only one element. The boat may be an inflatable boat.

In some implementations, the attaching base may be attachable to the receiving base using a hook-and-loop mechanism. The receiving base may be substantially flat. The receiving base may have one or more clearance holes and may be held by one or more screws to the attachment surface. The one or more optical sources may emit light with colors that are substantially red or green or white or the combination thereof. The one or more windows may be transparent or translucent or the combination thereof. The one or more windows may include color filters or coatings. The boat may be an inflatable boat.

In some aspects of the disclosure, a method is disclosed that provides a lighting assembly that includes a light housing, an attaching base, and one or more optical sources. The method includes providing a receiving base and enabling the receiving base to be attachable to an attachment surface of a boat. The method also includes enabling the attaching base to be attachable and detachable to the receiving base.

The attaching base may be attachable to the receiving base by magnetic force or using a hook-and-loop mechanism. The thickest portion of the receiving base may be less than 0.05 inches. The receiving base may be embedded in the attachment surface. The receiving base may have one or more clearance holes and may be held by one or more screws to the attachment surface. The one or more optical sources may emit light with colors that are substantially red or green or white or the combination thereof. The light housing may include one or more windows which may have color filters or coatings. The boat may be an inflatable boat.

The techniques and systems disclosed in this specification provide numerous benefits and advantages (some of which can be achieved only in some of the various aspect and implementations) including the following. The disclosed techniques may be used to provide a receiving base used for affixing a lighting assembly to be compact such that the receiving base may be stepped on by a person without causing accidental tripping. The probability that a person bumps into the receiving base may be reduced due to its small bulkiness and compact size, and thereby reducing possible injury. Because the lighting assembly is detachable from the receiving base, the lighting assembly may be stowed when not in use. This may reduce the possibility of damage to the lighting assembly.

Two or more of the features described in this disclosure, including those described in this summary section, may be combined to form implementations not specifically described herein.

The details of one or more implementations of the subject matter described in this disclosure are set forth in the accompanying drawings and the description below. Other features, objects, and advantages of the subject matter will be apparent from the description and drawings, and from the claims.

DESCRIPTION OF DRAWINGS

Like reference symbols in the various drawings indicate like elements.

DETAILED DESCRIPTION

An attachable lighting device may include a lighting assembly that can be mounted on a boat using a magnetic force, a hook-and-loop mechanism, etc. Such mechanisms allow the lighting assembly to be attached, e.g., non-permanently affixed, to the boat. A person may detach the lighting assembly when the lighting assembly is not needed. A receiving base used for affixing the lighting assembly may be substantially flat and substantially thin such that the receiving base may be stepped on by a person without causing accidental tripping which may result in injury. In this disclosure, an element that can be "attached" or "attachable" means that the element can be "detached" or "detachable" such that the "attached/detached" state may be repeatable.

Figure 1:
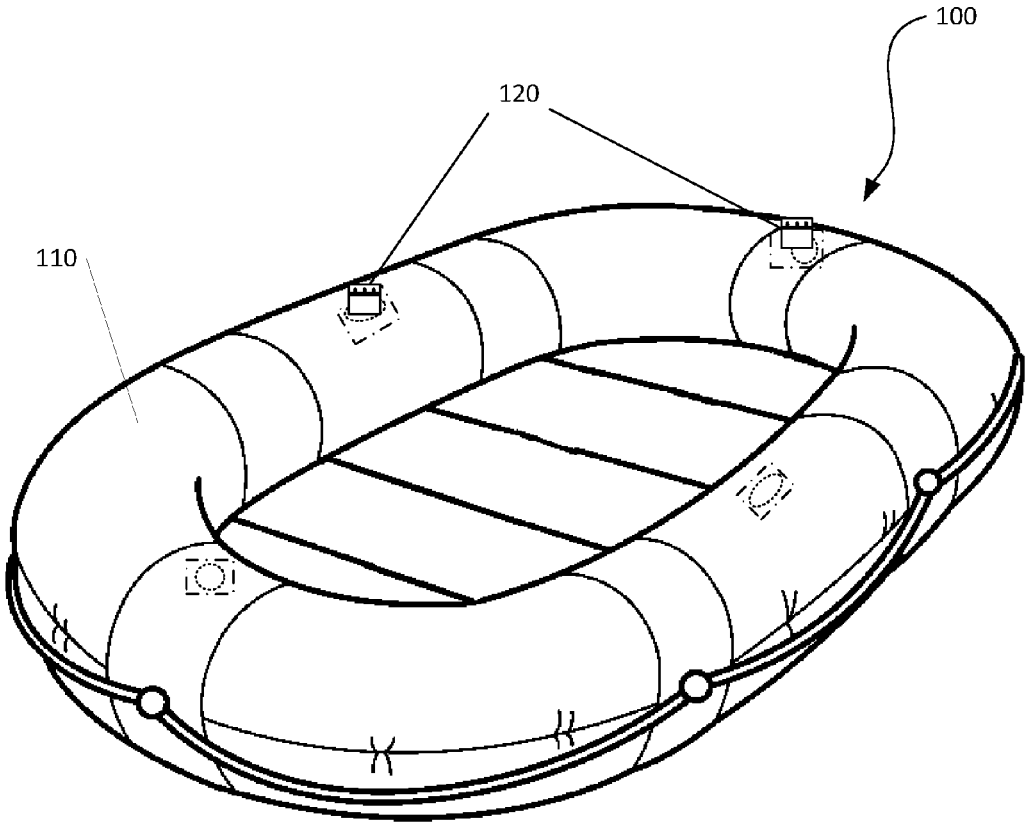
FIG. 1 illustrates an example of a boat.

FIG. 1 illustrates an example of a boat 100 with one or more attachable lighting devices 120. In some implementations, the boat 100 is an inflatable boat, e.g., a dinghy or a zodiac boat. The boat 100 may include any number of attachable lighting devices 120 which may be attached to an attachment surface 110 of the boat 100. The attachment surface 110 may be on any location of the boat 100. For example, the attachment surface 110 may be a location on the bow, stern, port, or starboard of the boat 100.

Figure 2A:
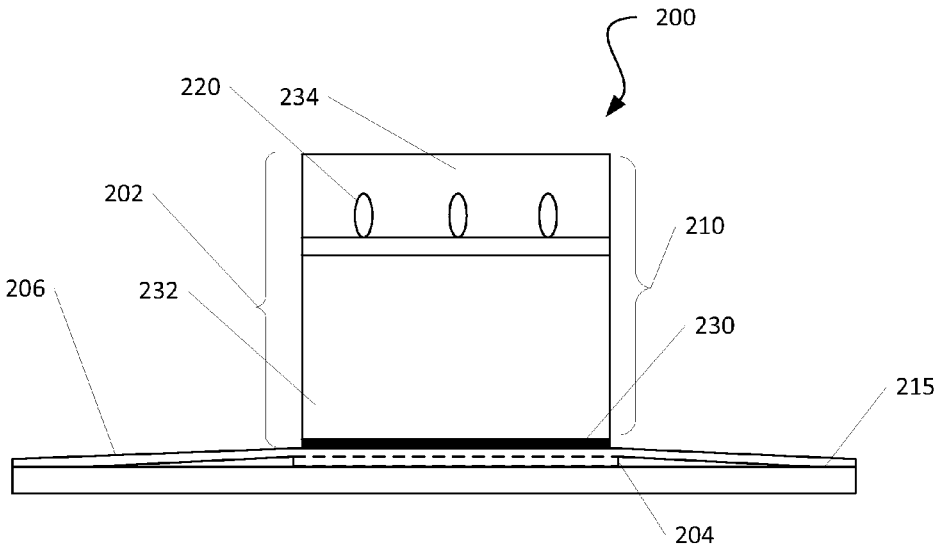
FIGS. 2A-2C are schematic side views of examples of attachable lighting devices.

FIG. 2A illustrates an example of an attachable lighting device 200 including a lighting assembly 202 and a receiving base 204. The lighting assembly 202 may include a light housing 210, an attaching base 230, and one or more optical sources 220. The light housing 210 may be configured to be fixed on top of the attaching base 230. The light housing 210 may contain the one or more optical sources 220 which may be of any type of light sources capable of producing the desired type and amount of lighting. The one or more optical sources 220 may emit light at the visible wavelength. For example, the one or more optical sources 220 may be one or more light emitting diodes (LEDs), high intensity discharge (HID) bulbs, fluorescent bulbs, or incandescent bulbs. In the example illustrated in FIG. 2A, the attaching base 230 is attached to a receiving base 204 by a magnetic force. In some implementations, a fixing device 206 may be used to attach the receiving base 204 to the top of the attachment surface 215 of a boat. For example, the fixing device 206 may cover the receiving base 204 such that the receiving base 204 may be firmly held against the top of the attachment surface 215. The fixing device 206 may be a tape or an adhesive, which can be removable so that the receiving base 204 may be moved to a new location on the boat. Then the tape or adhesive may be reapplied over the receiving base 204 to attach the receiving base 204 to the new location.

The fixing device 206 may comprise one or more elements. For example, the fixing device 206 may be one or more pieces of tape. In some implementations, the fixing device 206 may substantially cover the receiving base 204 (e.g., the fixing device 206 may cover more than 0%, 10%, 30%, 50%, 70%, 90%, etc. of the area of the receiving base 204.) In some implementations, the fixing device 206 may be substantially thin (e.g., less than 4 mm, less than 3 mm, less than 2 mm, or less than 1 mm.) The thickness of the fixing device 206 may affect the strength of attachment between the lighting assembly 202 and the receiving base 204, as explained below.

The attachment surface 215 may be made of a nonmagnetic material such as Hypalon™ or polyvinyl chloride (PVC) or the combination thereof. Various plastic/rubber like materials on the attachment surface 210 may allow the fixing device 206 to securely affix the receiving base 204 to the attachment surface 215.

In some implementations, the attaching base 230 may include a non-permanent magnetic material and the receiving base 204 may include a permanent magnetic material (e.g., ferromagnetic material). Alternatively, for example, the attaching base 230 may include a permanent magnetic material and the receiving base 204 may include a non-permanent magnetic material. In another implementation, the attaching base 230 and the receiving base 204 may both include permanent magnetic materials which may or may not be identical. The receiving base 204 and/or attaching base 230 may include steel, aluminum, zinc, cobalt, nickel, copper, lodestone, alloys, or electromagnets (e.g., solenoids.)

The receiving base 204 and/or the attaching base 230 can include a permanent magnetic material, which may be of one solid element or may be divided into a number of elements. The receiving base 204 and/or the attaching base 230 can include a non-permanent magnetic material, which may be of one solid element or may be divided into a number of elements.

In some implementations, the receiving base 204 is made of only one element. For example, the one element may be of one kind of material. This may reduce the cost of manufacture and the complexity of utilizing the attachable lighting device 200.

In the example illustrated in FIG. 2A, the lighting assembly 202 includes a canister 232 and a window 234. The canister 232 may contain a power source (e.g., battery) for power the one or more optical sources 220. The canister 232 may also include circuitry for controlling the light emission of the one or more optical sources 220. The window 234 may be made from plastic and/or glass materials. The canister 232 may be made from material suitable to withstand marine environments (e.g., plastic, metallic, or glass materials.) The lighting assembly 202 may be waterproof and sustain water pressure (e.g., over 1 bar, over 2 bar, over 3 bar) for at least 10 minutes.

In some implementations, the attaching base 230 may be attached to the receiving base 204 by a magnetic force. The magnetic force can be substantially strong to hold the attaching base 230, which may have the lighting assembly 202 attached on top, and the receiving base 204 together under harsh conditions, such as bouncing and pounding due to violent water. The attaching base 230 may be detached from the receiving base 204 by pulling the attaching base 230 away from the receiving base 204. The magnitude of the magnetic force necessary to keep the attaching base 230 attached to the receiving base 204 may vary depending on the size and weight of the lighting assembly 202, the location of the attachable lighting device 200, the conditions that the boat experiences, and the distance between the attaching base 230 and the receiving base 204, among other things. For example, the thickness of the fixing device 206 may affect the magnitude of the magnetic force between the lighting assembly 202 and the receiving base 204. A thinner fixing device 206 may result in a higher magnitude force of magnetic attraction between the lighting assembly 202 and the receiving base 204, while a thicker fixing device 206 may result in a lower magnitude force of magnetic attraction between the lighting assembly 202 and the receiving base 204.

Figure 2B:
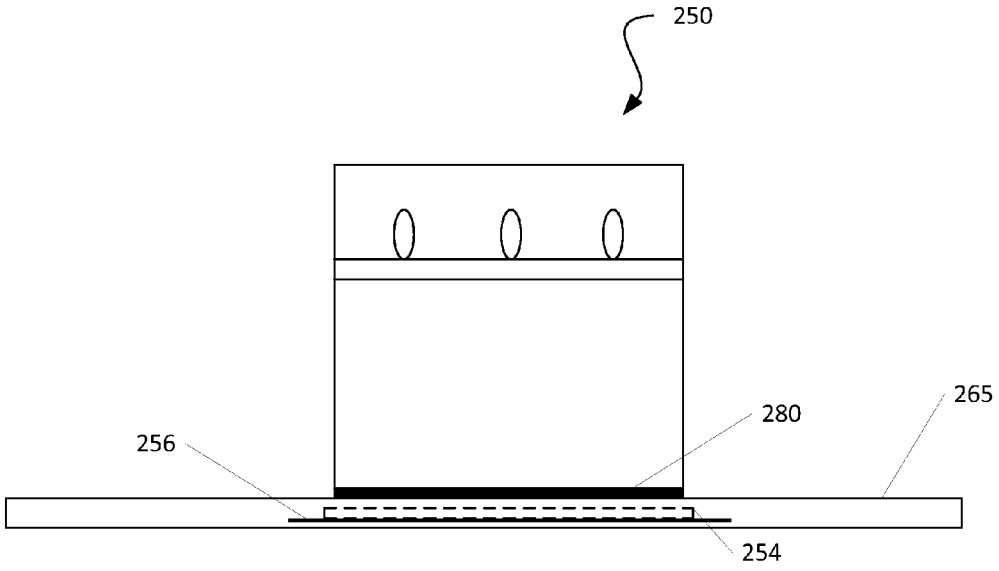
Figure 2C:
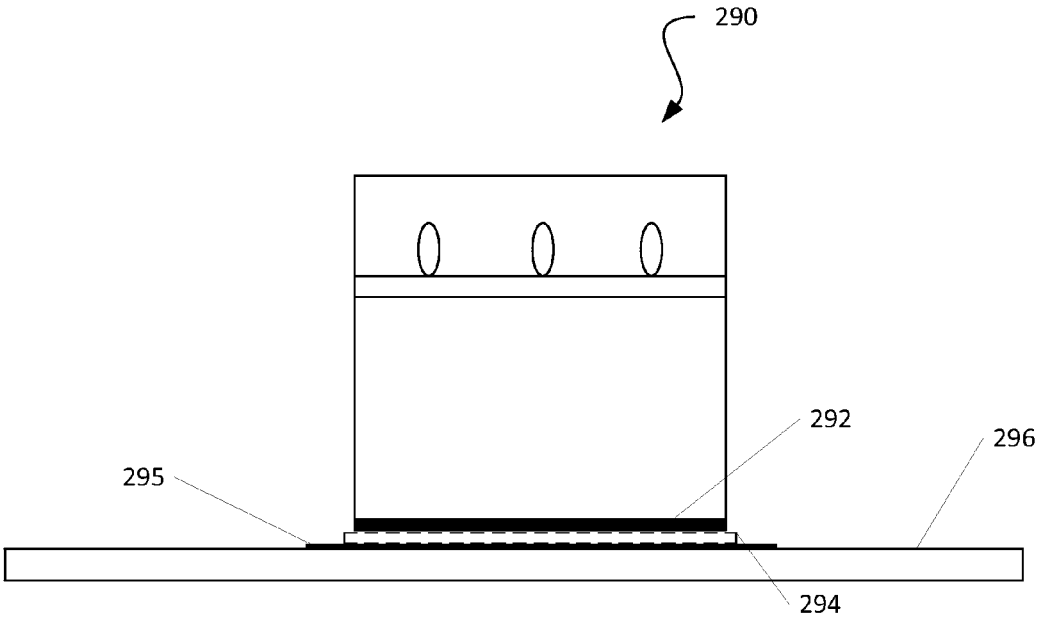

In the example illustrated in FIG. 2B, an attachable lighting device 250 includes an attaching base 280 attached to a receiving base 254 by a magnetic force with an attachment surface 265 of a boat in between the attaching base 280 and the receiving base 254. The attachment surface 265 may be an integral part of the boat. For example, the attachment surface 265 may be the exterior surface of the boat. In some implementations, a fixing device may be used to attach a receiving base on top of an attachment surface, as shown in FIG. 2A and FIG. 2C. Alternatively, a fixing device may be used to attach a receiving base under an attachment surface. In yet another alternative, a fixing device (e.g., fixing device 256 in FIG. 2B) may be used to attach a receiving base within an attachment surface, as shown in FIG. 2B.

A fixing device may be an adhesive material (e.g., glue or epoxy) as shown in FIG. 2B and FIG. 2C. A fixing device may be any piece of material that can secure or assist in securing a receiving base. For example, the fixing device may secure the receiving base by applying pressure to the receiving base so that the receiving base is pushed against an attachment surface, as shown in FIG. 2A.

In some implementations, an attachment surface may take the role of a fixing device. The fixing device may be part of the attachment surface. For example, the fixing device may be part of an enclosed area inside which a receiving base can be contained. The fixing device may secure the receiving base with or without the aid of an adhesive. The fixing device may be made of a material that creates friction between the fixing device and the receiving base to limit the movement of the receiving base. The enclosed area can have substantially the same size, shape, and volume as the receiving base such that the receiving base is sufficiently secured and prohibited from unwanted movement within the enclosed area.

In some implementations, an attachment surface may be a separate piece of material from the exterior surface of a boat. For example, the attachment surface may be a jacket that covers most of the exterior of the boat. A receiving base may be placed between the exterior surface of the boat and the attachment surface (e.g., the jacket). The jacket may be removable. For example, the jacket may be removed, the receiving base may be relocated, and the jacket may be placed to cover the receiving base and the boat. The attaching base may be attached to the receiving base with the jacket in between the two components.

In an example, an attachment surface (e.g., the jacket) may take the role of a fixing device. That is, the attachment surface may secure a receiving base by applying downwards pressure to secure the receiving base against the exterior surface of a boat. In an example, the receiving base is secured only by the downwards pressure of the attachment surface. The receiving base may be additionally secured by an adhesive (e.g., glue). For example, an adhesive can be used to secure the receiving base to the exterior surface of the boat, and the jacket can additionally secure the receiving base by applying downwards force to press the receiving base against the exterior surface of the boat. In this example, the adhesive would operate as a second fixing device.

In some implementations, an attachment surface may be a pocket sewn onto the exterior surface of a boat. A receiving base may be inserted into the pocket, and an attaching base may be attached to the receiving base via the intermediate material of the pocket. The receiving base may also be additionally secured within the pocket by an adhesive.

In the example illustrated in FIG. 2C, an attachable lighting device 290 includes an attaching base 292 attached to a receiving base 294 using a hook-and-loop mechanism. For example, the attaching base 292 can include fabric-implemented hooks and the receiving base 294 can include fabric-implemented loops or vice versa. A fixing device 295 may be positioned in between the receiving base 294 and an attachment surface 296 to attach the receiving base 294 to the attachment surface 296. In an example, the fixing device 295 is an adhesive (e.g., glue or epoxy). In another example, the receiving base 294 may have one or more clearance holes and an attachment surface 296 may have one or more fastener holes. The fixing device 295 may be one or more fasteners that can securely affix the receiving base 294 onto the attachment surface 296. For example, the fixing device 295 may be fastened into the one or more fastener holes of the attachment surface 296 through the one or more clearance holes of the receiving base 294.

Figure 3:
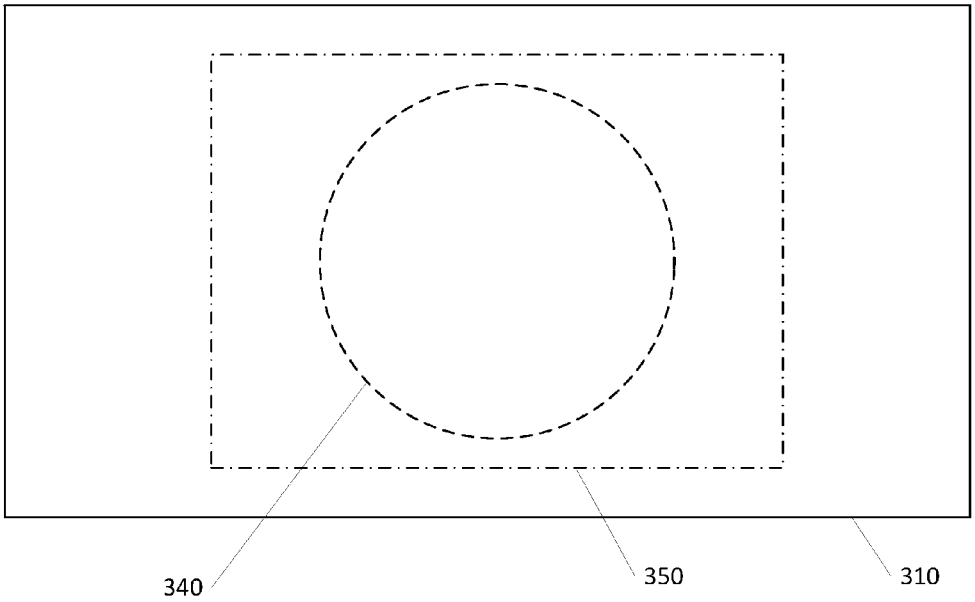
FIG. 3 is a schematic top view of an outline of an example of an attachable lighting device.

FIG. 3 is a schematic of an outline of a top view of an attachment surface 310 of a boat, a receiving base 340, and a fixing device 350. The attachment surface 310, the receiving base 340, and the fixing device 350 may be any shape. For example, the receiving base 340 may be a shim stock of a circular shape. Alternatively, the receiving base 340 may be a rectangular shape. The longest dimension of the receiving base 340 may be smaller than 2.5, 1.25, or 0.7 inches. In some implementations, the receiving base 340 may be substantially flat. The thickest portion of the receiving base 340 may be thinner than 0.1, 0.05, 0.03, or 0.01 inches. The receiving base 340 may be substantially flexible. The flatness and/or small thickness of the receiving base 340 may allow a person to step on the receiving base 340 without tripping and/or may reduce injuries when a person bumps into the receiving base 340, due to the reduced bulkiness and compact size.

A receiving base and an attaching base may have patterns on their surfaces. The patterned surfaces may assist to hold, orient, etc. the attaching base (e.g., shown in FIG. 2A). The patterned surfaces may require the attaching base to assume only one possible position in order to be attached to the receiving base. For example, if the attaching base is in the correct position, the attaching base may magnetically attract to the receiving base because the patterned surfaces bring the magnetic materials close enough together. In contrast, if the attaching base is not in the correct position, the attaching base may not sufficiently attract to the receiving base because the patterned surfaces do not bring the magnetic materials close enough together.

In some implementations, a receiving base may come in direct contact with an attaching base. Alternatively, a fixing device may be used to attach the receiving base on top of an attachment surface by applying pressure to the receiving base so that the receiving base is pushed against the attachment surface, as shown in FIG. 2A. In this implementation, the receiving base does not come into direct contact with the attaching base. Fixing device may be formed to fit the patterned surface of the receiving base such that the patterned surfaces of the attachment base and the receiving base are utilized, e.g., the patterned surface of the attachment base is able to attach to the patterned surface of the receiving base only if the attachment base is in the appropriate position.

In some implementations, a receiving base may be permanently embedded in an attachment surface of a boat at the time of manufacture of the boat. Alternatively, a receiving base may be embedded in an attachment surface of a boat after the time of manufacture of the boat.

Fixing device may be one or more fasteners that can securely affix a receiving base onto an attachment surface. For example, the fixing device may be fastened into the one or more fastener holes of the attachment surface through the one or more clearance holes of the receiving base.

A lighting assembly may be removed from an attachment surface of a boat and the lighting assembly can be stowed. Stowing the lighting assembly when not in use can reduce the possibility of damage to the lighting assembly. Removing the lighting assembly may reduce the possibility of the event that a person bumps into the lighting assembly or trips over the lighting assembly. This may reduce the chance that the person is injured due to the lighting assembly.

In some implementations, an attaching base may be attached to an attachment surface, a receiving base, or fixing device using a suction cup (not shown.) The suction cup uses negative fluid pressure of air, a fluid, etc. to adhere to surfaces. The suction cup may be coupled to a side or bottom of the lighting assembly. For example, the suction cup may be affixed to the bottom of the attaching base, and the suction cup can attach to a surface of the attachment surface, the receiving base, or the fixing device in the normal direction. The longest dimension of the suction cup may be smaller than 2.5 inches, 1.5 inches, or 0.5 inches. In these implementations, the attaching base and/or the receiving base need to be magnetic or has a hoop-and-loop mechanism. The attaching base and/or the receiving base may be made from plastic. In some implementations, the fixing device may be a suction cup.

One or more attachable lighting devices may be used to make a boat visible in the dark. In some implementations, the one or more attachable lighting devices may be used to signal the position, heading, and status of the boat to other parties, e.g., other nearby boats. For example, according to one convention, the boat may have an attachable lighting device on the starboard side emitting green light, another attachable lighting device on the port side emitting red light, and another attachable lighting device on the stern (e.g., engine) emitting white light. Alternatively, any other convention may be used such that a different number of attachable lighting devices may emit different colors of lights in different arrangements on the boat.

Figure 4A:
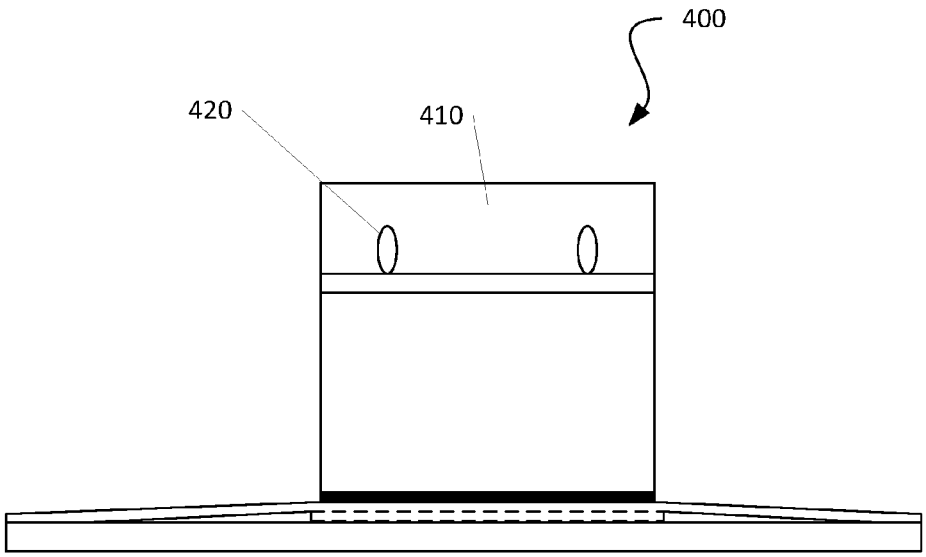
FIGS. 4A and 4B are schematic side views of examples of attachable lighting devices.

In some implementations, an attachable lighting device may provide light of a single color. In the example illustrated in FIG. 4A, an attachable lighting device 400 includes one or more optical sources 420 emitting visible light which is transmitted through a window 410. The visible light may be substantially a single color, e.g., red, green, or white. In some implementations, the color of the visible light passing through the window 410 may be substantially unaltered. Alternatively, the color of the visible light passing through the window 410 may be substantially altered. The window 410 may have a color filter or a coating that changes the observed color of the light.

Figure 4B:
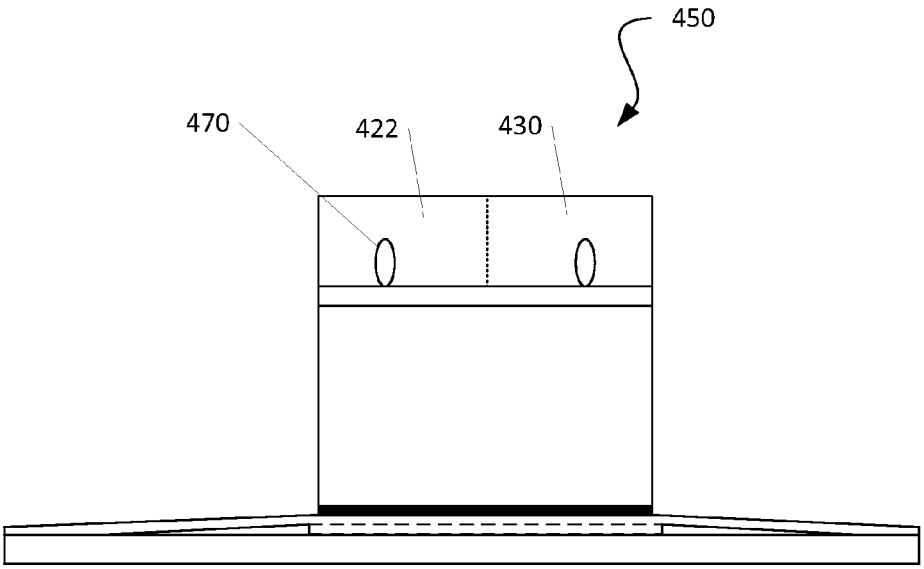

In some implementations, an attachable lighting device may provide substantially different colors of lights through different portions of a light housing. In the example illustrated in FIG. 4B, an attachable lighting device 450 includes a first window 422 and a second window 430 which may have identical or different color properties from each other. The first window 422 and the second window 430 may have color filters or coatings. The first window 420 and the second window 430 may be portions of one solid element or may be adjoined from multiple elements. In some implementations, the attachable lighting device 450 may include more than two windows.

The attachable lighting device 450 may include one or more optical sources 470 which may emit substantially white light. The white light passing through the window 422 may become a substantially different color if the window 422 has a color filter, coating, etc. For example, the white light passing through the window 422 may become substantially red and the white light passing through the window 430 may become substantially green. This may be achieved by applying color filters or coatings on the first window 422 and the second window 430.

In some implementations, an attachable lighting device may include one or more optical sources configured to emit more than one substantially different color. For example, in FIG. 4B, the one or more optical sources 470 may emit substantially red light in a first range of directions through a first window 422 and substantially green light in a second range of directions through a second window 430. In some implementations, the window 422 and the window 430 may be uncolored such that the color of the light passing through the first window 422 and the second window 430 may be substantially unaltered. Alternatively, in some implementations, the first window 422 and the second window 430 may each be colored to match the color of lights being emitted by the one or more optical sources 470. For example, the first window 422 may be substantially red and the second window 430 may be substantially green.

Generally, one or more windows included in an attachable lighting device may be transparent or translucent. The one or more windows may be uncolored. The one or more windows may be colored by applying color filters or coatings. In some implementations, the one or more windows may include fluorescent material.

Figure 5:
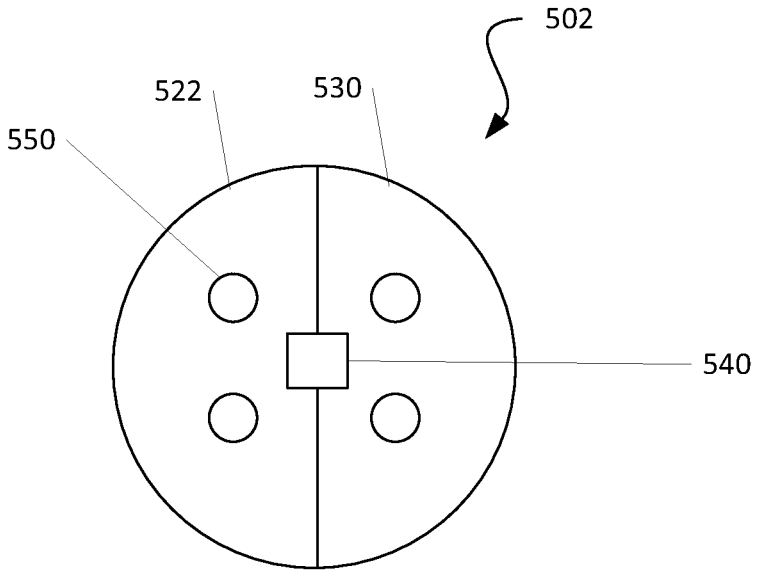
FIG. 5 is a schematic top view of an example of a lighting assembly.

FIG. 5 illustrates an example of the lighting assembly 502 with first window 522 and second window 530 as viewed from the top. The lighting assembly 502 may include a button 540 that may be configured to activate one or more optical sources 550 depending on how many times the button 540 is pressed. For example, the one or more optical sources 550 may include red and green light sources, and if the button 440 is pressed once, the red light sources may be activated; if the button 540 is pressed a second time, the green light sources may be activated; if the button is pressed a third time, both the red and the green light sources may be activated; if the button is pressed a fourth time, all light sources may be turned off. In some implementations, the lighting assembly 502 may include multiple buttons 540, and each button may be configured to control one or more of the optical sources 550. The one or more buttons 540 may be placed in any location on the lighting assembly 502. In some implementations, the one or more optical sources 550 may be controlled by at least one toggle switch or a remote control.

In some implementations, a lighting assembly may be powered by at least one battery (e.g., alkaline, lithium battery.) The at least one battery may be a rechargeable battery (e.g., fuel cell, lithium-ion, nickel cadmium battery.) In some implementations, the lighting assembly may be powered by a solar cell or by a solar panel.

Multiple lighting assemblies may be configured to be attachable to a single receiving base. This reduces the number of receiving bases need to attach numerous lighting assemblies.

Instructions may be displayed near or on a visible part of an attachable lighting device. For example, the instructions may direct the orientation of an attachable lighting device mounted on a boat so that the attachable lighting device may provide information pertaining to the position, heading, and status of the boat to other parties, e.g., other nearby boats. The instructions may guide a person to detach and stow the attachable lighting device when not in use.

Figure 6:
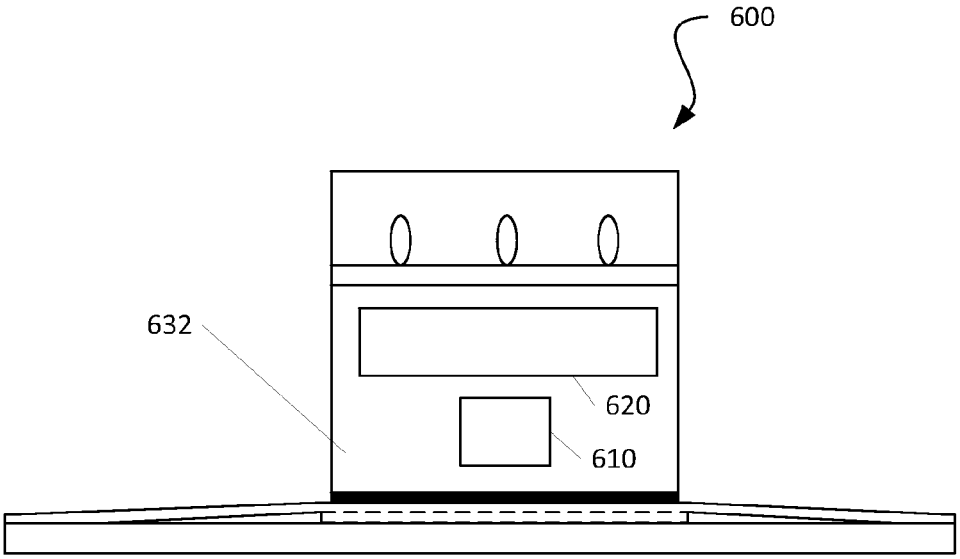
FIG. 6 is a schematic side view of an example of an attachable lighting device.

FIG. 6 illustrates an example of an attachable lighting device 600 including a navigation device 610 (e.g., compass, directing finding antenna, global positioning system, etc.). The navigation device 610 can assist a person on a boat to find directions (e.g., north, south, east and west). In this example, the navigation device 610 is located on a side wall of canister 632, which can be cylindrical, rectangular, etc. In some implementations, other devices such as a clock can be positioned next to or instead of the navigation device 610. In this approach, the attachable lighting device 600 can include instruments, which can be used by the person in the boat.

The canister 632 can include a solar panel 620 on its sidewall. The solar panel 620 can be used to power instruments such as a clock or navigation device 610 if needed. Thus, if the instruments cannot be provided energy by a battery (e.g., due to charge loss), the instruments may still operate by receiving power from the solar panel 620. In some arrangements, the solar panel may be used to recharging one or more batteries, which in turn may provide energy to the instruments.

Figure 7:
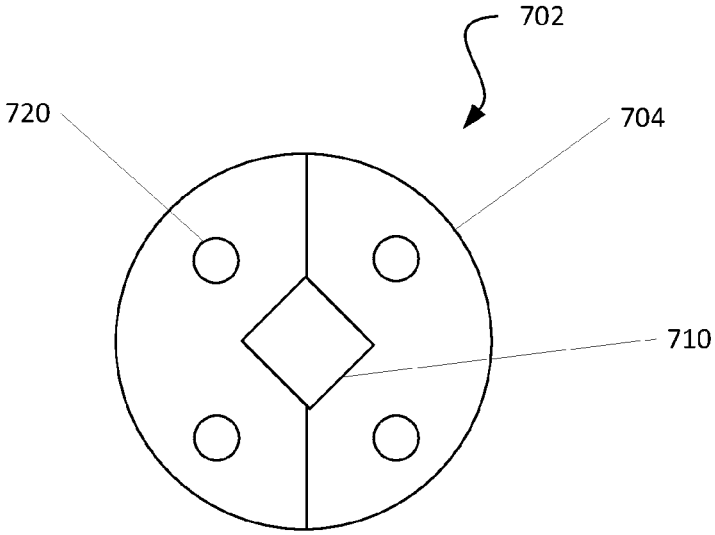
FIG. 7 is a schematic top view of an example of a lighting assembly.

FIG. 7 illustrates another example of a lighting assembly 702 in a top view, which includes a location 710 on top of light housing 704. The lighting assembly 702 includes one or more optical sources 720. Elements such as a navigation device, clock, solar panel, etc. can installed at the location 710. Such elements can operate in a similar manner described in relation to FIG. 6. In some implementations, certain elements can be located on top of the light housing 704 and certain elements can be located on side walls of a canister of the lighting assembly 702. The lighting assembly 702 can contain devices such as radio circuit, which can be used to send out or receive communication signals. Such devices can be powered by the solar panel and/or batteries installed in the lighting assembly 702.

In some implementations, magnetic materials used in a receiving base and/or an attaching base can be flexible magnetic materials.

Elements of different implementations described herein may be combined to form other implementations not specifically set forth above. Elements may be left out of the processes, systems, apparatus, etc., described herein without adversely affecting their operation.

Various separate elements may be combined into one or more individual elements to perform the functions described herein.

Other implementations not specifically described herein are also within the scope of the following claims.

What is claimed is:

1. An attachable lighting device comprising:

a lighting assembly comprising:

a light housing, an attaching base, and one or more optical sources, the light housing attached to the top of the attaching base and containing the one or more optical sources; and a substantially flat receiving base attachable to an attachment surface of a boat, wherein the receiving base is embedded in the attachment surface;

wherein the attaching base is attachable to the receiving base by magnetic force.

2. The attachable lighting device of claim 1, wherein the thickest portion of the receiving base is less than 0.05 inches.

3. The attachable lighting device of claim 1, wherein the receiving base has one or more clearance holes and can be held by one or more screws to the attachment surface.

4. The attachable lighting device of claim 1, wherein the one or more optical sources emit light with colors that are substantially red or green or white or the combination thereof.

5. The attachable lighting device of claim 1, wherein the light housing comprises one or more windows, the one or more windows being transparent or translucent or the combination thereof.

6. The attachable lighting device of claim 5, wherein the one or more windows comprise one or more color filters or coatings.

7. The attachable lighting device of claim 1, wherein the receiving base is made from only one element, and the boat is an inflatable boat.

8. The attachable lighting device of claim 1, wherein the attaching base is attachable to the receiving base using a hook-and-loop mechanism.

9. The attachable lighting device of claim 8, wherein the receiving base has one or more clearance holes and can be held by one or more screws to the attachment surface.

10. The attachable lighting device of claim 8, wherein the one or more optical sources emit light with colors that are substantially red or green or white or the combination thereof.

11. The attachable lighting device of claim 8, wherein the light housing comprises one or more windows, the one or more windows being transparent or translucent or the combination thereof.

12. The attachable lighting device of claim 11, wherein the one or more windows comprise color filters or coatings.

13. The attachable lighting device of claim 8, wherein the boat is an inflatable boat.

14. A method comprising:

providing a lighting assembly that comprises a light housing, an attaching base, and one or more optical sources;

providing a receiving base;

enabling the receiving base to be attachable to an attachment surface of a boat, wherein the receiving base is embedded in the attachment surface; and enabling the attaching base to be attachable and detachable to the receiving base by magnetic force or using a hook-and-loop mechanism.

15. The method of claim 14, wherein the thickest portion of the receiving base is less than 0.05 inches.

16. The method of claim 14, wherein the receiving base has one or more clearance holes and can be held by one or more screws to the attachment surface.

17. The method of claim 14, wherein the one or more optical sources emit light with colors that are substantially red or green or white or the combination thereof.

18. The method of claim 14, wherein the light housing comprises one or more windows, the one or more windows having color filters or coatings.

19. The method of claim 14, wherein the boat is an inflatable boat.

* * * * *